US006415582B2

(12) United States Patent
Graushar et al.

(10) Patent No.: US 6,415,582 B2
(45) Date of Patent: Jul. 9, 2002

(54) METHOD OF SELECTIVE WRAPPING OF PRODUCTS

(75) Inventors: William T. Graushar, Wauwatosa; John C. Geres, West Allis, both of WI (US)

(73) Assignee: Quad/Graphics, Inc., Sussex, WI (US)

( * ) Notice: Subject to any disclaimer, the term of this patent is extended or adjusted under 35 U.S.C. 154(b) by 0 days.

(21) Appl. No.: 09/835,430

(22) Filed: Apr. 16, 2001

Related U.S. Application Data

(63) Continuation of application No. 09/333,710, filed on Jun. 15, 1999, now Pat. No. 6,269,609.

(51) Int. Cl.[7] ..... B65B 61/02; B65B 35/30; B65B 57/10

(52) U.S. Cl. ..... 53/411; 53/443; 53/445; 53/461; 53/498

(58) Field of Search ..... 198/341.03, 341.06, 198/347.2, 347.4; 53/399, 411, 427, 441, 442, 443, 445, 447, 461, 463, 498, 499, 154, 168, 203, 52

(56) References Cited

U.S. PATENT DOCUMENTS

| | | | | | |
|---|---|---|---|---|---|
| 3,173,557 | A | * | 3/1965 | Eliassen | 198/347.4 |
| 3,696,580 | A | * | 10/1972 | Saltzer, Sr. | 53/442 |
| 4,484,733 | A | * | 11/1984 | Loos et al. | 53/411 |
| 4,683,708 | A | * | 8/1987 | Linder | 53/168 |
| 4,959,795 | A | * | 9/1990 | Christensen et al. | 53/154 |
| 5,007,521 | A | * | 4/1991 | Tanaka | 198/347.4 |
| 5,025,610 | A | * | 6/1991 | Graushar | 53/461 |
| 5,103,617 | A | * | 4/1992 | Sjogren et al. | 53/449 |
| 5,113,639 | A | * | 5/1992 | Bryson | 53/461 |
| 5,414,974 | A | * | 5/1995 | Van de Ven et al. | 53/399 |
| 5,630,309 | A | * | 5/1997 | Blidung et al. | 53/443 |
| 5,706,632 | A | * | 1/1998 | Kivits et al. | 53/443 |
| 5,720,157 | A | * | 2/1998 | Ross | 53/445 |

FOREIGN PATENT DOCUMENTS

| | | | |
|---|---|---|---|
| GB | 1231444 | * | 12/1971 |

* cited by examiner

*Primary Examiner*—Stephen F. Gerrity
*Assistant Examiner*—Louis Huynh
(74) *Attorney, Agent, or Firm*—Michael Best & Friedrich LLP

(57) ABSTRACT

An apparatus and a method to produce magazines, books, catalogues, brochures, periodicals, or the like on a collation or binding line, transport these products in a single stream of products towards a packaging line, divide the single stream of products into distinct streams of products where one such stream comprises products requiring wrapping and another such stream comprises products which do not require wrapping, transport the products requiring wrapping to a wrapping machine and sending these products through a wrapping process, transport the products that do not require wrapping around the wrapping machine, and merge the separate streams of products back into a single stream of products such that the products are arranged in a predetermined output order, such as demographic order.

20 Claims, 6 Drawing Sheets

METHOD OF SELECTIVE WRAPPING OF PRODUCTS

RELATED APPLICATIONS

This application is a continuation of U.S. patent application Ser. No. 09/333,710, filed June 15, 1999, now U.S. Pat. No. 6,269,609."

FIELD OF THE INVENTION

The present invention relates, generally, to an apparatus and a method for wrapping selected products found in a stream of a plurality of products. More particularly, the present invention relates to an apparatus and a method which combines a binding or stitching operation and a wrapping operation into a single operation which divides the stream of products into at least two additional streams of products, i.e., a stream of products to be wrapped and a stream of products not to be wrapped, whereafter the divided streams of products are merged again into a single stream of products in a desired output order, such as demographic order.

BACKGROUND OF THE INVENTION

During the processing of magazines, newspapers, books, periodicals or other sheet material products or articles, it is sometimes desirable to wrap selected articles with, for example, paper or conventional band wrapping or plastic film which may be a polymeric or polyethylene plastic film. There are many different reasons for selectively wrapping certain articles from a series of articles. This flexibility is important in satisfying the demands of a particular market or geographical destination. For instance, it may be desirable to offer certain customers or subscribers various features or selected advertising depending upon their special interest, income or occupation. Likewise, it may be relevant to customize products or services contingent upon a customer's previous buying history. For example, a publication may issue one demo edition for parents of newborn children who have previously purchased baby products, another edition for farmers interested in the latest agricultural equipment and still another edition for recent purchasers of exercise equipment. In each situation, a publisher may utilize various modes of customization such as blown-in card feeding, invoicing, advertising material insertion, renewal notices and tipping, as well as several types of contact or contactless printing. As a result, it is usually desirable to wrap the products including one or more of these items in order to enclose such loose items.

It is generally understood that magazines or other products can be packaged in such a way so as to take maximum advantage of postal discounts. For example, grouping a certain number of products and sending these products to subscribers having a common five-digit zip code in the same carrier route, qualifies the packages for a lower postal rate thereby saving the publisher money. Therefore, it is preferred that a bindery output articles in an order that facilitates sorting and packaging to maximize postal discounts.

Currently, collation and binding (conveyor) lines for stitchers build magazines, catalogues, brochures, periodicals, etc. in an order that facilitates sorting and packaging so as to receive such postal discounts. Each product binding line typically comprises an inserter having a plurality of signature feeders, a collating chain or conveyor, a customizing station, a stitcher, a trimmer, a labeling station, a bad book conveyor, a stacker and a strapper, as known to those skilled in the art. Once products are assembled and packaged in a desired order, the products are typically delivered to a Post Office for continued delivery to their final destination. So as not to create a slowdown in the overall production of the products, wrapping lines are generally separate and apart from binding lines. As previously pointed out, it is sometimes desirable to customize products with certain advertising or promotional material. It is also sometimes desirable to preserve the appearance of products. Customizing certain products with additional material or protecting certain products from damage requires that these products be wrapped with a protective wrapping. Wrapping machines conventionally apply a transparent polywrap material or paper wrap material or band wrap material around each individual product sent through a respective wrapping line. Like the binding lines, the wrapping lines output the products in an order that facilitates sorting and packaging so as to also enable certain postal discounts.

One problem with separate and distinct binding and wrapping lines is that bundles of products produced by each separate line are delivered to the appropriate Post Office and these bundles typically have overlapping zip codes thereby not fully utilizing the overall savings that could be realized through postal discounts. Therefore, it would be beneficial to provide an apparatus and a method which are capable of combining a binding line and a wrapping line so as to maximize postal discounts by eliminating such overlapping zip codes. However, because the production processes between a binding line and a wrapping line are not generally compatible, combining these two systems into a single system has heretofore been difficult to accomplish. As a result, bundles from binding lines and wrapping lines are often manually combined together to eliminate overlapping zip codes. However, this manual operation is generally unacceptable because any postal discounts achieved by packaging the products according to matching zip codes are outweighed by the expenses associated with the manual labor needed to organize the bundles.

SUMMARY OF THE INVENTION

Accordingly, the present invention provides the advantage of conveniently and efficiently combining a binding line with a wrapping line to eliminate the need for separate and distinct binding and wrapping operations thereby reducing manufacturing and labor costs while at the same time maximizing postal discounts. The present invention also provides an apparatus and a method which offer a greater degree of product customization. Further, the present invention provides an apparatus and a method which selectively wrap individual products found in a stream of products and yet are also capable of combining the wrapped and unwrapped products into a desired output so as to maximize postal discounts.

In one aspect, the present invention provides an apparatus for wrapping selected products of a plurality of products. The products are assembled on a conveyor line according to coded information. The plurality of products continuously moves in a stream of products toward a packaging assembly which is operatively connected to the conveyor line. A deflecting device positioned along the stream of products divides the stream of products into at least two additional streams of products. The present invention contemplates selectively diverting certain products according to coded information either to a wrapping line where products are wrapped or to a non-wrapping line where products are not wrapped. The present invention further contemplates merging the wrapped products and non-wrapped products in another conveyor line according to a predetermined output order whereafter the stream of products is delivered to packaging equipment before shipment to a Post Office.

The present invention may be further characterized in that a control system is adapted to receive coded information of each product to be produced prior to the start of the manufacturing process. The control system processes the coded information to determine which products of the plurality of products require wrapping. Based on the desired final demographic output order and based upon the information as to which products out of the plurality of products require wrapping, the control system determines the order of assembly for each of the plurality of products. The control system then communicates with the appropriate components of the binding operation and the packaging operation in order to ensure that the proper output order of products is obtained.

The present invention may also be characterized in that the wrapping line comprises a pre-buffer zone, a wrapping device and a post-buffer zone. The deflecting device moves the selected products to be wrapped to the pre-buffer zone of the wrapping line. A predetermined number of products are collected in the pre-buffer zone before such products are delivered to the wrapping device. According to one aspect of the present invention, products to be wrapped are continuously fed to the wrapping device so as to improve the overall operation of the wrapping device. The pre-buffer zone is adapted to collect and feed products to the wrapping device to ensure a continuous translation of products to be wrapped. The post-buffer zone collects the wrapped products prior to delivering the wrapped products to a further destination.

According to another aspect of the present invention, the wrapping line is designed to feed wrapped products to a downstream conveyor line such that the wrapped products merge or commingle with the unwrapped products which were diverted into the non-wrapping line. In this manner, the present invention allows wrapped products to join up with non-wrapped products to output a predetermined order of the products.

The present invention also relates to a method for selectively wrapping certain products of a stream of products according to coded information. The method includes inputting coded information into a control system which processes the information to determine which products require wrapping. The method further includes generating an order of assembly for the products taking into account the filling of the pre and post-buffer zones such that the output of the products will be in a desired order, such as demographic order. The method also includes continuously moving the stream of products along a first path and dividing the stream of products into at least two additional streams of products, one containing those products to be wrapped and the other containing those products not to be wrapped. The method incorporates a manner of merging the two additional streams of products back into a combined stream whereby the products are arranged in the predetermined output order as originally inputted to the control system.

It is therefore a feature of the present invention to provide an apparatus and a method which contain the features and advantages set forth herein and which are much simpler in design.

It is another feature of the present invention to provide an apparatus and a method which improve the customizing capability for high speed demographic binders and wrappers. Specifically, according to the present invention, prior separate binding and wrapping operations can now be combined into a single processing operation which allows for selective wrapping of certain products and an output of products which contains wrapped and unwrapped products and, yet, which also maximizes postal discounts.

It is yet another feature of the present invention to provide an apparatus and method which allow for selective wrapping of products from a plurality of products and which are particularly versatile and capable of improving existing systems.

Other features and advantages of the invention will become apparent to those skilled in the art upon review of the following detailed description, claims, and drawings in which like numerals are used to designate like features.

Figure 1:
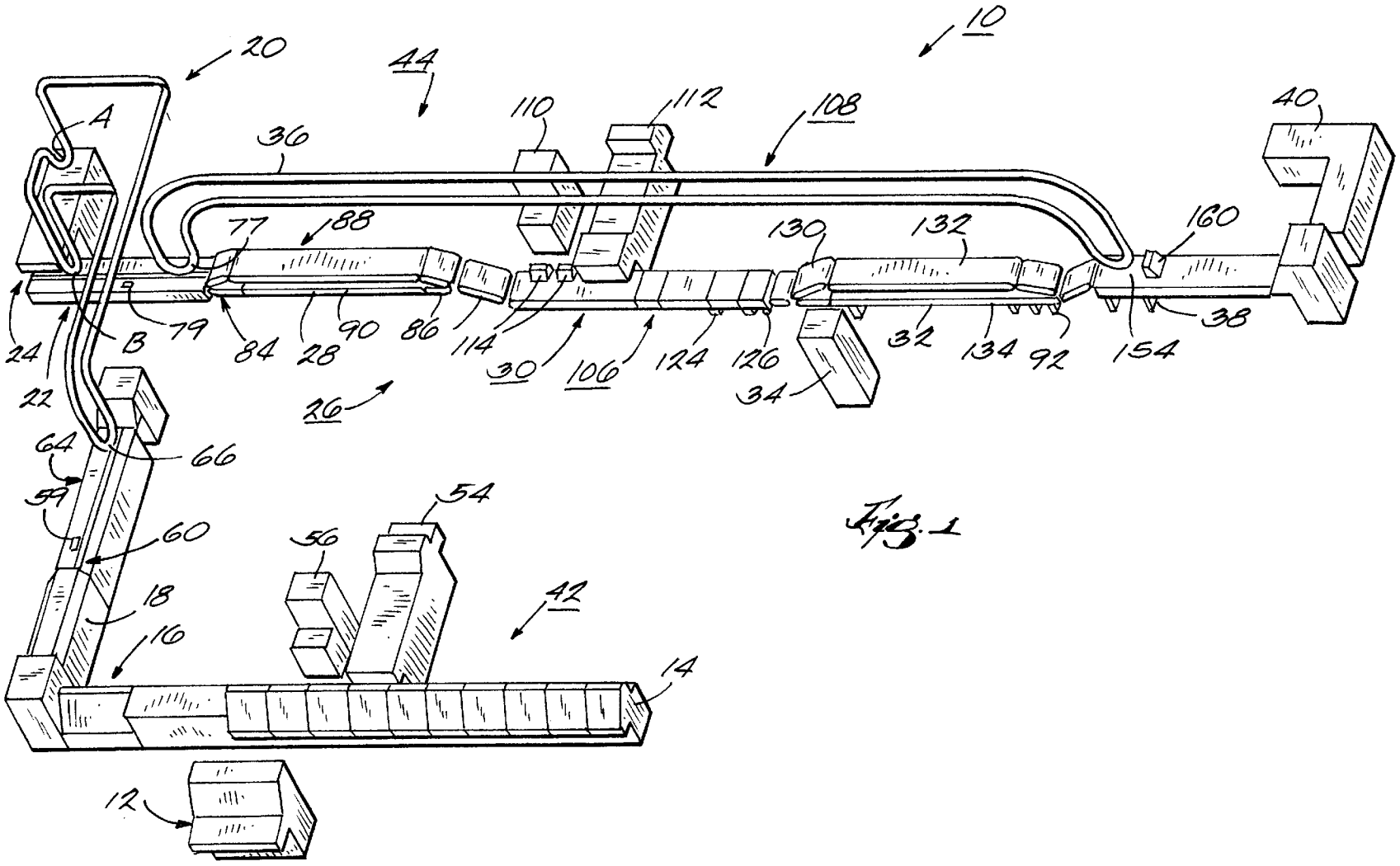
FIG. 1 is a top elevational view of a processing line for practicing a method embodying the present invention.
Figure 2:
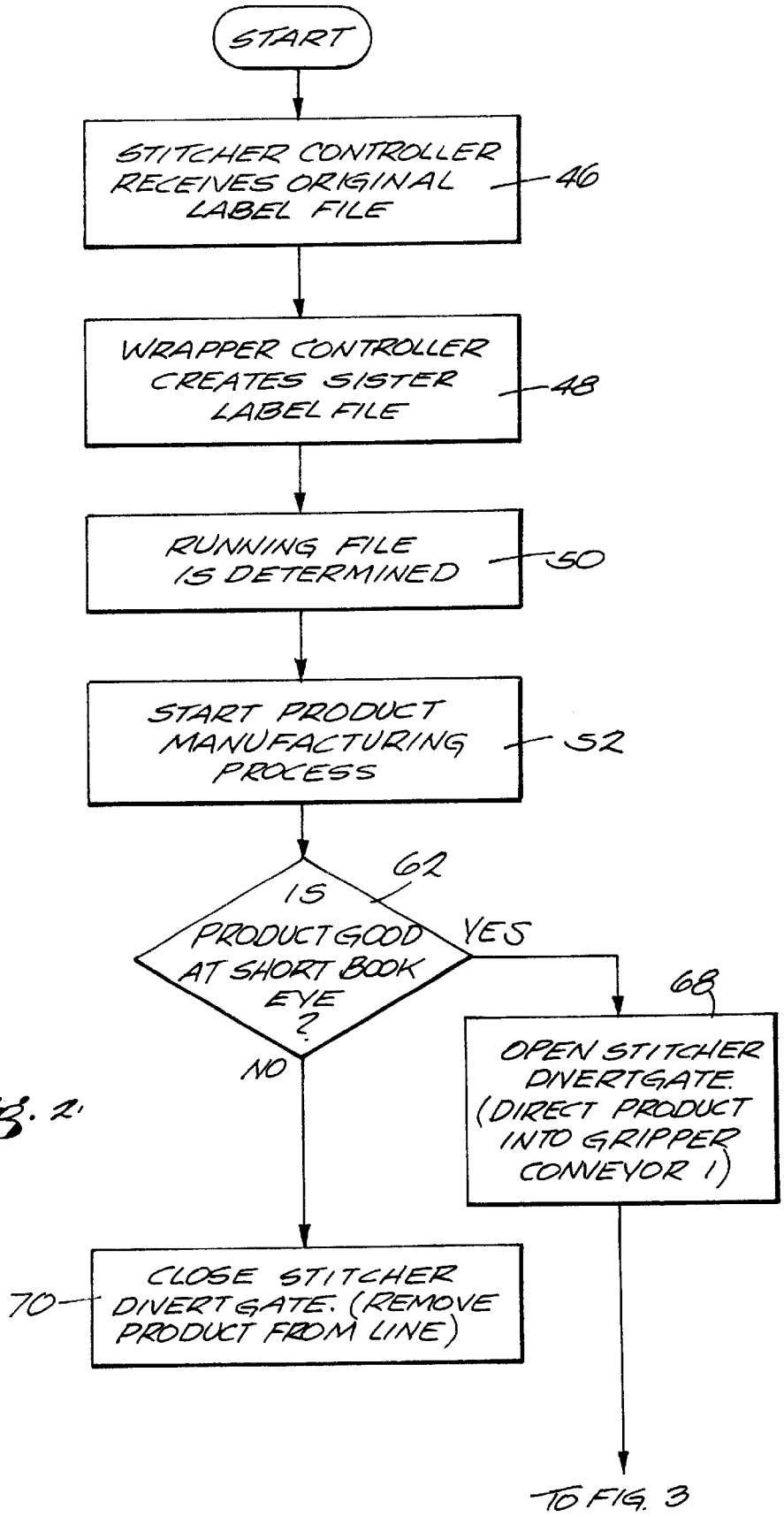
FIGS. 2–6 are flow charts illustrating the selective wrapping process embodying the present invention.
Figure 3:
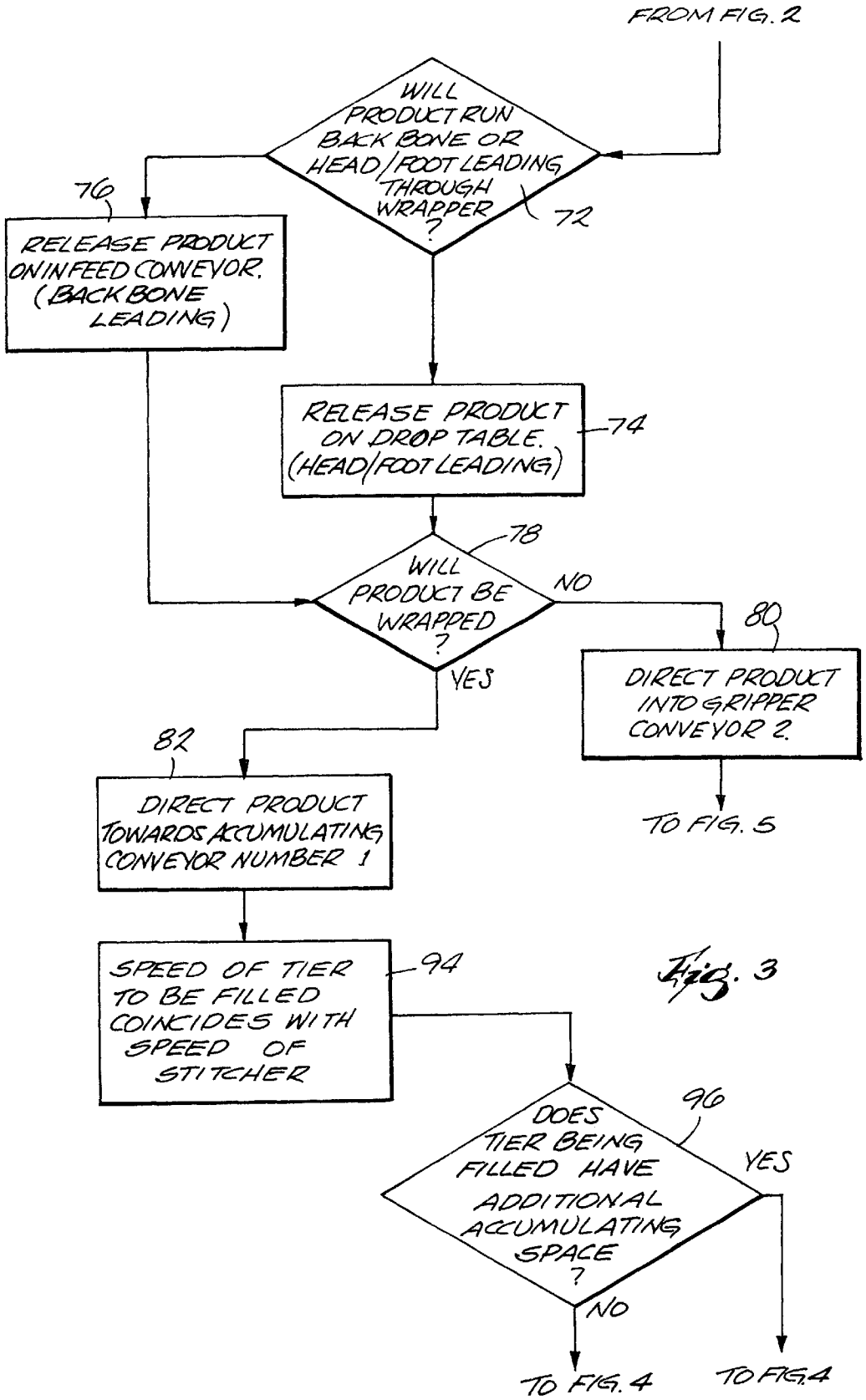
Figure 4:
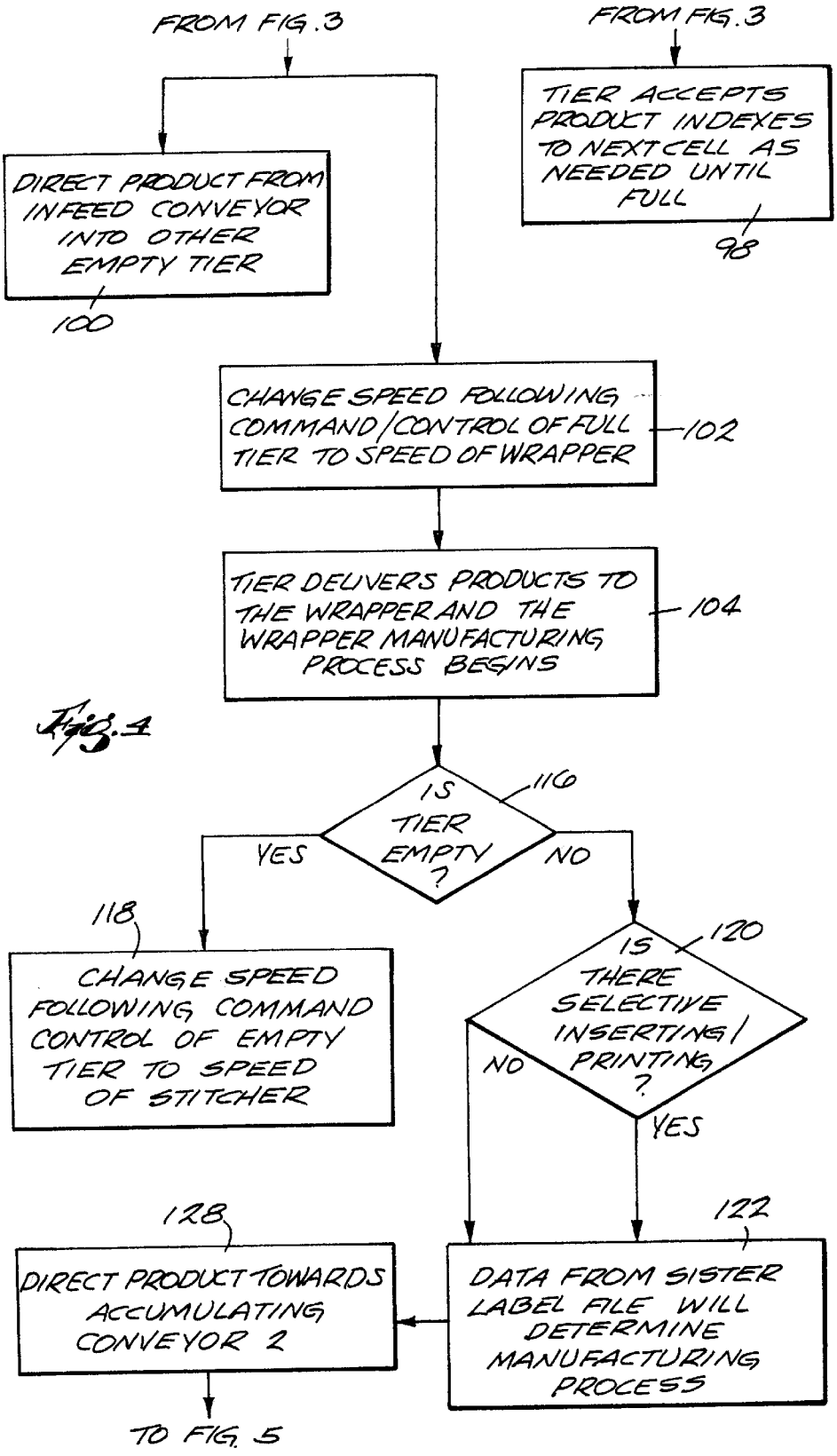
Figure 5:
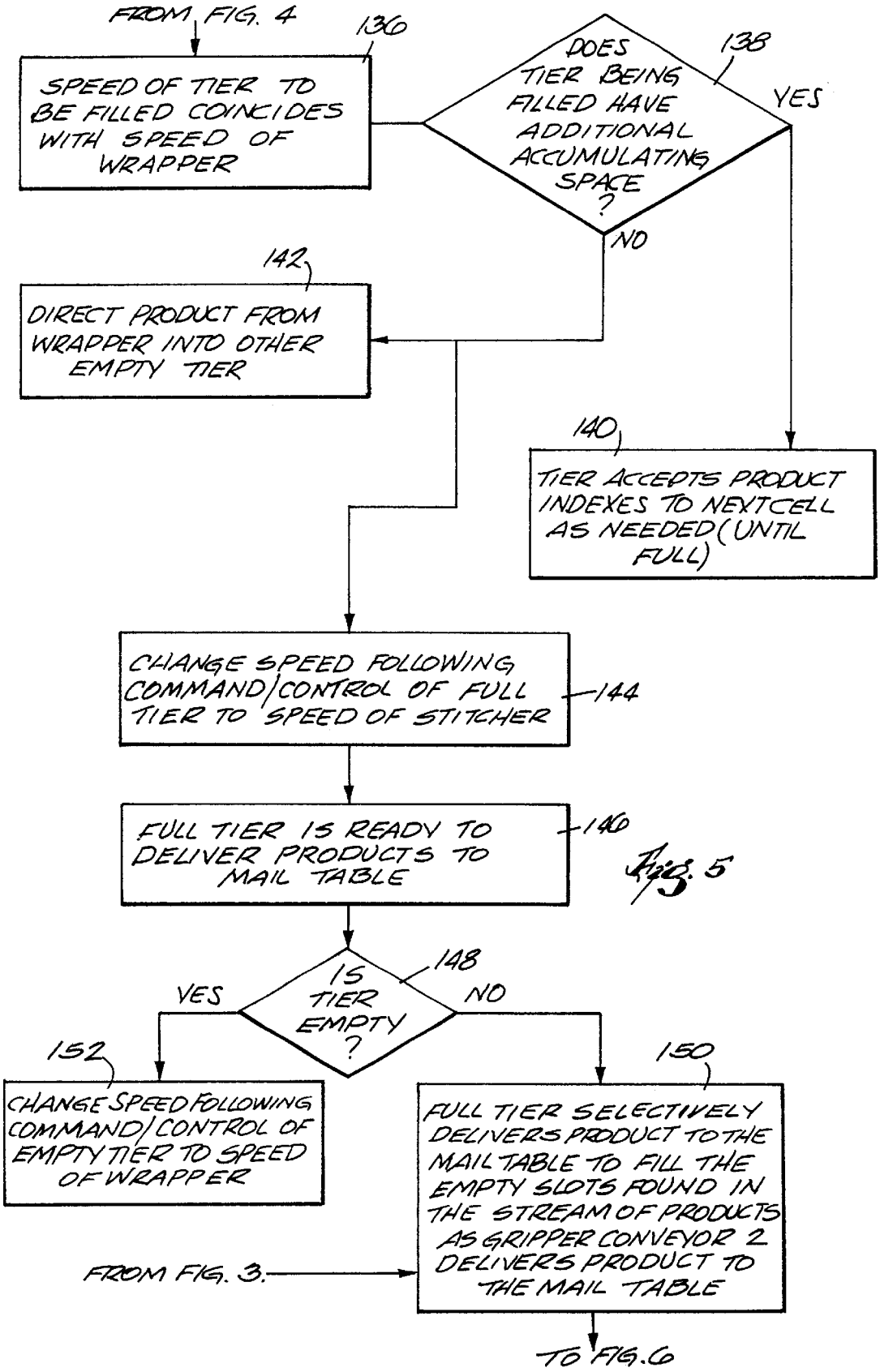
Figure 6:
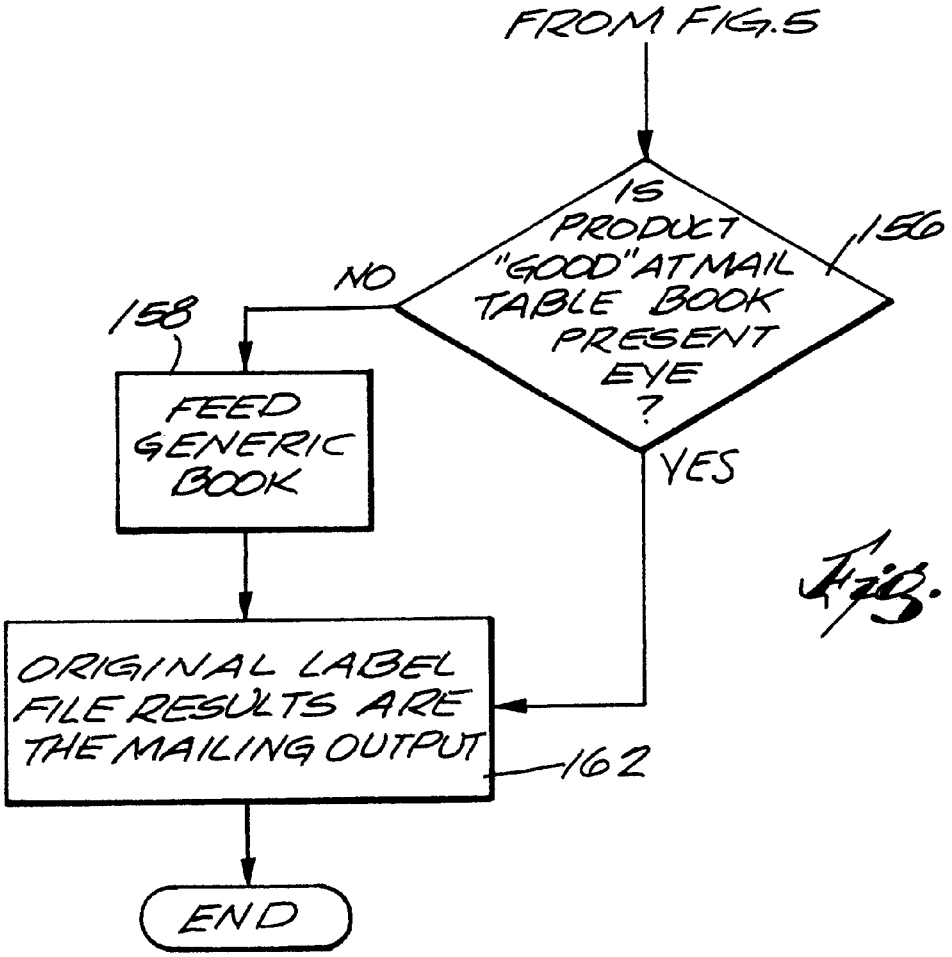

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter and equivalents thereof. The use of letters to identify steps of a method or process is simply for identification and is not meant to indicate that the steps should be performed in a particular order.

DETAILED DESCRIPTION OF THE PREFERRED EMBODIMENT

Illustrated in FIG. 1 is an in-line processing system 10 according to the present invention for processing products or articles which may include newspapers, magazines, books or the like. The processing system 10 includes a stitcher controller or assembly controller 12, an assembly line 14, a binder or stitcher 16, a trimmer 18, a gripper conveyor 20 which conveys products from the trimmer 18 to an in-feed conveyor 22 or a drop table 24, a wrapping assembly 26 which includes a pre-wrapper accumulating conveyor 28, a wrapper 30, a post-wrapper accumulating conveyor 32, and a wrapper controller 34, a wrapper bypassing conveyor 36 which conveys selected products from the in-feed conveyor 22 to a mail table 38, and further processing equipment such as packaging equipment 40. Various inkjet units, printer feeders, feeder pockets and product diverters may be positioned at various places along the processing system 10 as needed and/or as desired as will be further discussed below. The processing system 10 according to the present invention combines an assembly operation 42 with a packaging operation 44 in a single in-line processing system 10 which provides an output stream of products destined for delivery to, for example, a United States Post Office.

A feature of the system 10 is the system's capability to individually wrap selected products. A product may be individually wrapped if, for example, the product such as a magazine is the first issue going to a customer or subscriber and an invoice is to be included in the wrapping. Other products may not have to include an invoice and, therefore, they would not have to be wrapped. If a product is not to be wrapped, the product is picked up by the wrapper bypassing conveyor 36 which bypasses the wrapping assembly 26 and drops the products off at the mail table 38. Those products that are intended to be wrapped are sent on to the wrapping assembly 26. The products to be wrapped are held in the pre-wrapper accumulating conveyor 28 until a predetermined sufficient number of products have been collected. After a certain number of products have been accumulated in the pre-wrapper accumulating conveyor 28, the products are passed to the wrapper 30 for individual wrapping. After the products are wrapped, the products are transported to the post-wrapper accumulating conveyor 32. The products are then held within the post-wrapper accumulating conveyor 32 until such time as the a products join up and merge with the bypassed products traveling along the wrapper bypassing conveyor 36 at the mail table 38 in order to produce the desired output order. A feature of the present invention is to allow selective wrapping of certain products and output a combined desired order of wrapped and non-wrapped products.

To further illustrate the present invention, the invention will now be described with reference to the flow chart shown in FIGS. 2–6 in conjunction with the apparatus shown in FIG. 1. Any reference to a piece of equipment in the processing system 10 will be shown in FIG. 1. Any reference to a Box will correspond to a process step found in the flow chart depicted in FIGS. 2–6.

To begin, a label file, comprising, for example, subscriber names, codes, addresses, messages, etc., is downloaded or inputted to the stitcher controller 12 (Box 46). The label file includes information which corresponds to each particular article or product of a set of products to be processed by the system 10. Generally, the label file includes: coded information (a product build descriptor) designating the particular feeders to be activated along the binding line 14 to build each product (i.e., the particular component signatures of the product); indicia of the identity and address of the subscriber for which each product is being assembled; and customization information, e.g., a particular message to be printed in each product, actuation indicia for a card inserter, an application device or the like. Such customization information may also include a coded designation (product selection control field) identifying products for which customized packaging is to be effected, e.g., the particular onset dispensing units to be actuated, and when printers or inkjet units are to be employed.

The inputted label file is referred to as the original label file. The label file is downloaded to the stitcher controller 12 in a particular order which preferably represents the desired output order of the products to be processed by the system 10. In other words, the products can be received by the mail table 38 and sent on to the packaging equipment 40 according to the order set forth in the original label file. The label file may be downloaded to the stitcher controller 12 in any number of proven ways such as, for instance, a magnetic tape or diskette or through any other known electronic means. Importantly, the label file includes an identifier for each product that requires wrapping. The stitcher controller 12 may be any type of suitable controller commonly known to those skilled in the art, such as an FCS 1000 or an FCS 2000 inkjet controller from Quad/Tech, Inc., of Sussex, Wis., which is particularly suited for use according to the present invention.

After the stitcher controller 12 receives the original label file, the wrapper controller 34 scans the original label file searching for the wrapper identifiers in order to determine which products require wrapping. The wrapper controller 34 may also be any type of suitable controller commonly known to those skilled in the art. However, the controllers identified above and available from Quad/Tech are particularly suited for use according to the subject invention. The stitcher controller 12 and the wrapper controller 34 should be capable of electronically communicating with each other. As the wrapper controller 34 scans the original label file found within the stitcher controller 12, the wrapper controller 34 creates a sister label file (Box 48). The sister label file contains the information for those products from the original label file that are intended to be wrapped.

After the wrapper controller 34 generates the sister label file, the wrapper controller 34 also generates a running file which sequentially lists the order of the products as they will be assembled in the assembly line 14 (Box 50). As will be further explained below, the running file takes into account the accumulation of the products in the pre and post-buffer zones. Thus, preferably, the order of the products in the running file does not correlate with the order of the products in the original label file. Once the running file is generated and the wrapper controller 34 communicates with the stitcher controller 12, the manufacturing process begins (Box 52).

The stitcher controller 12 controls the assembly process of the individual products as the products travel through the assembly operation 42. The first part of the manufacturing process includes assembling the products in the assembly line 14 which is made up of a collation line and/or a binding line as shown in FIG. 1. The products are assembled in the assembly line 14 according to the order set forth in the running file.

One or more printer feeders 54 may be positioned along the assembly line 14 in order to selectively feed inserts/onset such as invoices, promotional material etc. within selected products or magazines as is well known in the art. One or more inkjet units or printers 56 may also be positioned along the assembly line 14 to selectively print on individual signatures as the signatures travel past the inkjet units 56 as is also well known in the art. Data from the original label file will identify which products receive inserts/onset or selective printing. The stitcher controller 12 will electronically communicate with the printer feeders 54 and/or inkjet units 56 and/or other similar devices to identify when selective inserting/onserting or printing is desired for a given product being assembled.

After individual signatures are assembled into collated products, the products are bound by a binder or stitcher 16. Once bound, the individual products are sent through the trimmer 18. As generally understood by those skilled in the art, the trimmer 18 functions to trim or cut excessive material from each product and attempts to square one page of the product to the next.

After the trimmer 18, a sensor assembly 59 is properly positioned at or around reference numeral 60 so as to determine if each product is acceptable to continue on through the processing system 10 (Box 62). The sensor of the sensor assembly, also called a short book eye, may be an electronic sensor, an infra-red sensor or any other type of sensor in which, preferably, an emitter and a receiver are utilized. If after being trimmed, a product is not properly squared or is too short or is too long for example, the sensor assembly 59 will indicate that the product is unacceptable to continue on through the processing system 10. Typically, the sensor assembly operates in such a manner that if the emitter and the receiver of the sensor assembly are blocked at the same time, the product is usually acceptable. If the sensor eyes are not blocked at the same time, the product is usually not in a condition to continue.

If the product is acceptable at sensor assembly 59, a signal is sent by the sensor assembly 59 to the stitcher controller 12 so that a divert gate (not shown) positioned along the trimmer line 64 at or around reference numeral 66 is opened and the product is directed into the gripper conveyor 20 or gripper conveyor 1 so that the product can continue on through the processing system 10 (Box 68). If the product is not acceptable at sensor assembly 59, a signal is sent by the sensor assembly 59 to the stitcher controller 12 so that the divert gate is closed and the product is removed from the processing system 10 by suitable reject mechanisms (not shown) (Box 70). The stitcher controller 12 electronically communicates with the divert gate instructing the gate to open or close as needed.

There are many different configurations of assembly lines, printer feeders, inkjet units, stitchers, stitchers, trimmers, sensors and divert gates known to those skilled in the art which are readily available from numerous commercial sources and which are capable for use according to the principles of the present invention. The manner of assembling, inserting, printing, binding and trimming the products is well known in the art and does not independently play a significant part of the present invention.

It should be noted that the assembly operation 42 may be monitored for the occurrence of errors in any number of known ways. Sensors or encoders may be located at strategic locations in the assembly operation 42 and/or packaging operation 44 to sense the presence of acceptable or unacceptable products. The controllers 12 and 34 will communicate with the appropriate mechanisms to remove an unacceptable product at a chosen location.

Continuing on through the system 10, products that pass the divert gate in the trimmer line 64 are picked up by the gripper conveyor 20 which connects the assembly operation 42 with the overall packaging operation 44. The gripper conveyor 20 may be any type of conveyor suitable for use according to the principles of the present invention, which is generally known to those skilled in the art and readily available from numerous commercial sources. However, a single-copy gripper conveyor such as a NP-200 available from Heidelburg Finishing Systems, Inc., of Dayton, Ohio, is suitable for use according to the present invention. At this point, products will continue on through the system 10 either backbone/spine leading or head/foot leading through the remainder of the system 10. The original label file contains coded information which will inform the stitcher controller 12 whether the products in a set of products will travel backbone/spine leading or head/foot leading through the packaging operation 44. Based upon this information, the stitcher controller 12 will instruct the gripper conveyor 20 as to how the products will continue on through the system 10 (Box 72).

Preferably, for a given set of products, all of the products will either run backbone/spine leading or head/foot leading through the packaging operation 44, not a combination of the two. As shown, the gripper conveyor 20 either drops the products off at point A or point B. If the products are to travel head/foot leading through the system 10, the products are dropped off at point A on the drop table 24 (Box 74). If the products are to travel backbone/spine leading through the system 10, the products are dropped off at point B on the in-feed conveyor 22 (Box 76). The drop table 24 may be a lugged conveyor generally known to those skilled in the art and commercially available from numerous sources. The in-feed conveyor 22 may be any type of conveyor suitable for use according to the principles of the present invention, such as a lugged conveyor of the same type as the drop table 24.

As the products travel along the in-feed conveyor 22, it must be determined whether a product is intended to be wrapped or not (Box 78). The sister label file identifies which products in the stream of products are destined for the wrapper 30. The wrapper controller 34 tracks the position of each product moving along the in-feed conveyor 22 by preferably employing a conventional encoder 79 positioned along the conveying line 22. The wrapper controller 34 will instruct the wrapper bypassing conveyor 36 which products to take possession of out of the stream of products and which products to let pass. Although not shown, a divert gate may be positioned at or around reference numeral 77 to direct those products not destined for the wrapper 30 into the wrapper bypassing conveyor 36.

If a product is not intended to be wrapped, that product is picked up by the wrapper bypassing conveyor 36. If a product is intended to be wrapped, that product is directed toward the wrapping assembly 26 (Boxes 80 and 82). Those products directed into wrapper bypassing conveyor 36 or gripper conveyor 2 will eventually be delivered to the mail table 38 as will be further explained below. The wrapper bypassing conveyor 36 may be any type of conveyor suitable for use according to the principles of the present invention. However, a conveyor like gripper conveyor 20 is suitable for use according to the present invention.

The first portion of the wrapper assembly 26 includes a first diverting conveyor 84, the pre-wrapper accumulating conveyor 28, and a second diverting conveyor 86. The pre-wrapper accumulating conveyor 28 or accumulating conveyor number 1 preferably includes at least two tiers, a top conveyor tier 88 and a bottom conveyor tier 90. The purpose of providing at least two tiers will be more fully explained below. It is contemplated that the pre-wrapper accumulating conveyor 28 comprises an indexing conveyor which cooperates with a clutch assembly in order to index or advance a cell or a slot one cell at a time as needed, or when a product is set to be delivered to the conveyor 28. The first diverting device or diverting conveyor 84 is located directly upstream of the pre-wrapper accumulating conveyor 28. The diverting conveyor 84 directs products into one or the other of the tiers 88 and 90 depending on which tier 88 or 90 is accepting products.

Located directly downstream of the pre-wrapper accumulating conveyor 28 is the second diverting device or diverting conveyor 86. This diverting conveyor 86 conveys products from one or the other of the tiers 88 and 90 into the second portion of the wrapper assembly 26 or wrapper 30 depending on which tier 88 or 90 is emptying products. The diverting devices may be of any commonly known diverting assemblies but diverting conveyors designed to separate a single stream of products into a plurality of streams of products or to combine a plurality of streams of products into a single stream of products are particularly suitable for use according to the principles of the present invention. The overall cooperation between the diverting conveyors 84 and 86, pre-wrapper accumulating conveyor 28 and the wrapper 30 will be more fully set forth below.

In a typical manufacturing process, products are assembled, bound and trimmed at a rate of around 200-300 products per minute. The speed of the stitcher 16 or assembly operation 42 generally determines the rate at which products are assembled, bound and trimmed. The gripper conveyor 20, the drop table 24, the in-feed conveyor 22, the wrapper bypassing conveyor 36, the diverting conveyor 84, the diverting conveyor 92 (described below), and the mail table 38 preferably operate at the same speed as the stitcher 16 or assembly operation 42. Preferably, the speed of the tier 88 or 90 accepting products coincides with the speed of the stitcher 16 or assembly operation 42 (Box 94). In this way, successive products entering the appropriate tier 88 or 90 will not collide with each other. If collision were to occur, this could cause the entire system 10 to jam up which would require the system 10 to be shut down in order to clear away the jam.

As will be further explained, only one tier 88 or 90 is adapted to accept products at any given time. Wrapper controller 34 sends a signal to diverting conveyor 84 instructing the diverting conveyor 84 as to which tier 88 or 90 it should direct products. Products destined for the wrapper 30 are fed into the selected tier 88 or 90 for so long as the selected tier 88 or 90 has additional accumulating space (Box 96). As the tier 88 or 90 accepts products, the tier 88 or 90 will index to the next open cell until the tier 88 or 90 is full (Box 98). A scanner, such as a scanner which utilizes an emitter and a receiver which is generally known to those skilled in the art and readily available from numerous commercial suppliers, may be appropriately positioned along the pre-wrapper accumulating conveyor 28 in order to send a signal to the wrapper controller 34 when the tier 88 or 90 accepting products is full.

Upon learning that the tier 88 or 90 accepting products is full, the wrapper controller 34 sends a signal to the diverting conveyor 84 instructing the diverting conveyor 84 to direct the next line of products into the other or empty tier 88 or 90 (Box 100). This previously empty tier 88 or 90 continues to accept products for so long as it has additional accumulating space or until full and then the diverting conveyor 84 shifts again in the same manner as above so as to divert the next line of products into the other or now empty tier 88 or 90. Preferably, as one tier 88 or 90 is accepting products, the other tier 88 or 90 is emptying products into the wrapper 30.

Once tier 88 or 90 is full and a signal has been sent to the wrapper controller 34, the wrapper controller 34 sends a signal to the full tier 88 or 90 to change the speed of the full tier 88 or 90 to follow the speed of the wrapper 30 (Box 102). For the same reasons that the tier 88 or 90 that is accepting products should travel at the same speed as the stitcher 16 or assembly operation 42, the tier 88 or 90 feeding products to the wrapper 30 should travel at the same speed as the wrapper 30. Generally, a wrapper 30 will not travel as fast as a stitcher 16 or assembly operation 42. Thus, the tiers 88 and 90 of the pre-wrapper accumulating conveyor 28 are preferably independently driven to travel at different speeds since the wrapper 30 generally works at a different speed than assembly operation 42.

Once the speed of the full tier 88 or 90 has been changed to match that of the wrapper 30, the full tier 88 or 90 is set to deliver products to the wrapper 30 and the wrapping process can begin (Box 104). The wrapper 30 may be any type of wrapper known to those skilled in the art which is compatible with the principles of the subject invention. The wrapper 30 generally applies a transparent plastic film or paper wrap or band wrap, etc., around each product sent to the wrapping assembly 26. The wrapper 30 should be capable of enveloping, severing, heating and sealing a plastic-like or paper-like protective film or packaging around each product. One such wrapper which is suitable for use according to the present invention is a L80-750 poly-wrapper, available from Sitma U.S.A. Corp., of St. Paul, Minn.

A feature of the present invention is to send a number of products through the wrapper 30 one after the other rather than intermittently send the products through a wrapper. The plastic film wrapping material used by a wrapper can be difficult to control, as can be appreciated by those skilled in the art. The wrapping material is very thin and extremely flimsy. As such, it is desirable to control the tension of the wrapping material. A continuous wrapping operation or at least a wrapping operation which operates to wrap sets of a plurality of products in a continuous manner leads to better control over the wrapping material versus an intermittent operation. Also, wrappers generally use knives to cut the wrapping material and heaters to heat the film or plastic or adhesive it utilizes so as to seal the wrapping material. The temperature of the knives and heaters affects the overall operation of a wrapper. Operating a wrapper continuously or at least for periods of continuous operation allows for better control over the temperatures of the knives and heaters thereby further enhancing the operation of a wrapper.

Positioned along the wrapper line 106 and/or the wrapper bypassing line 108 may be one or more inkjet units 110 and/or one or more printer feeders 112 similar to those previously described with reference to the assembly line 14. Additionally, feeder pockets 114 may also be positioned along the wrapper line 106. Feeder pockets 114 are generally known to those skilled in the art and are readily available from numerous sources. The inkjet units 110 and/or printer feeders 112 can personalize a product with an insert or an onset such as an invoice. The feeder pockets 114 can also personalize a product with an insert or an onset such as a promotional product which may include a CD-ROM disk or the like. When placing an insert in or an onset on a particular product, it is important to place the insert or the onset in the correct position in or on the product. An improperly placed insert or onset may adversely affect the wrapping process as can be appreciated by those skilled in the art.

The continuous wrapping process according to the present invention helps maintain the proper placement of an insert or an onset versus the stop-and-go wrapping method of the prior art. As known in the art, some of the coatings found on certain products such as magazines are shinny and/or slippery. If an insert or an onset such as a CD-ROM disk is placed in or on a product, the intermittent motion of prior art wrapper systems can cause the insert or the onset to be shaken off of or out of the product or at least slid from the original position. The smooth continuous process of the wrapper 30 according to the present invention minimizes the undesirable results of an insert or an onset falling off of or out of a product or from shifting to an undesirable location on or in the product.

The tier 88 or 90 delivering products to the wrapper 30 continues to deliver products to the wrapper 30 until such time as that tier 88 or 90 is empty (Box 116). Once the tier 88 or 90 is completely emptied, a scanner, like the scanner previously described in reference to indicating when tier 88 or 90 is full, may be appropriately positioned along the pre-wrapper accumulating conveyor 28 in order to send a signal to the wrapper controller 34 such that the wrapper controller 34 changes the speed of the now emptied tier 88 or 90 back to the speed of the stitcher 16 or assembly operation 42 so that the now emptied tier 88 or 90 is ready to accept products once the other tier 88 or 90 is full (Box 118).

As noted, as the products make their way through the wrapper 30, the products may undergo selective inserting, onserting or printing (Box 120). This information is controlled by the information contained within the original label file and copied to the sister label file (Box 122). After the wrapper 30 wraps the product and the film is sealed by the wrapper 30 at a seal bar section 124, the products are directed through an accelerator section 126 and towards the post-wrapper accumulating conveyor 32 or accumulating conveyor number 2 (Box 128).

The post-wrapper accumulating conveyor 32 is a part of a third portion of the wrapper assembly 26 which also comprises a first diverting conveyor 130 and the second diverting conveyor 92. The post-wrapper accumulating conveyor 32 is similar to the pre-wrapper accumulating conveyor 28, and, therefore, the post-wrapper accumulating conveyor 32 preferably includes at least two tiers, a top conveyor tier 132 and a bottom conveyor tier 134. The pair of diverting conveyors 130 and 92 cooperate with the post-wrapper accumulating conveyor 32. Preferably, whichever tier 88 or 90 of the pre-wrapper accumulating conveyor 28 is feeding product to the wrapper 30, the diverting conveyor 130 will direct product into the corresponding top 132 or bottom 134 tier of the post-wrapper accumulating conveyor 32. Whichever tier 132 or 134 is being filled, the speed of that tier 132 or 134 as controlled by the wrapper controller 34 will match that of the wrapper 30 (Box 136). The tier 132 or 134, accepting products will continue to accept products, for so long as the selected tier 132 or 134 has additional accumulating space (Box 138). As the tier 132 or 134 accepts products, the tier 132 or 134 will index to the next open cell until the tier 132 or 134 is full (Box 140).

A scanner such as the scanners described in reference to the pre-wrapper accumulating conveyor 28 may be properly positioned along the post wrapper accumulating conveyer 32 to send a signal to the wrapper controller 34 when the tier 132 or 134 accepting products is full. Upon learning that the tier 132 or 134 is full, the wrapper controller 34 sends a signal to the diverting conveyor 130 instructing the diverting conveyor 130 to direct the next line of wrapped products into the other or empty tier 132 or 134 (Box 142). This previously empty tier 132 or 134 continues to accept product for so long as it has additional accumulating space or until full and then the diverting conveyor 130 shifts again in the same manner as above so as to divert the next line of products into the other or now empty tier 132 or 134. Preferably, as one tier 132 or 134 is accepting product, the other tier 132 or 134 is emptying product as will be further explained.

Once tier 132 or 134 is full and a signal has been sent to the wrapper controller 34, the wrapper controller 34 sends a signal to the full tier 132 or 134 to change the speed of the full tier 132 or 134 to follow the speed of the stitcher 16 or assembly operation 42 (Box 144). The full tier 132 or 134 is now ready to deliver products to the mail table 38 (Box 146). As should be apparent, tiers 132 and 134 are preferably independently driven.

Until the full tier 132 or 134 is empty (Box 148), the tier 132 or 134 selectively delivers product to the mail table 38 to fill the empty slots found in the stream of products as the wrapper bypassing conveyor 36 delivers product to the mail table 38 (Box 150). The merging of the products from the wrapper bypassing conveyor 36 and the wrapper 30 at the mail table 38 will be further explained below with reference to the example provided herein. Once the tier 132 or 134 is empty, preferably a signal is sent to the wrapper controller 34 by a scanner similar to those provided for above, so that the wrapper controller 34 can change the speed following command of the now empty tier 132 or 134 to return to that of the wrapper 30 for the reasons stated above (Box 152).

The mail table 38 is similar to the in-feed conveyor 22 but may be any type of conveyor suitable for use according to the present invention. The products will be processed along the mail table 38 preferably according to the order sent forth in the original label file. That is, preferably, the wrapped products that travel through the wrapper assembly 26 and the unwrapped products which bypass the wrapper assembly 26 by traveling along the wrapper bypassing conveyor 36, are combined at the mail table 38 according to the order of the original label file. Once the products reach the mail table 38, a sensor assembly, like the sensor assembly positioned along the trimmer line 64, may be properly positioned at or around reference numeral 154 so as to determine if each product is acceptable to be packaged for mailing (Box 156). Although not shown, a sensor like the one just mentioned may be appropriately placed along the wrapper line 106 to determine if each product should continue on or be removed from the processing system 10 consistent with the teachings of the present invention.

If the product is acceptable at the mail table 38, the product continues on to the packaging equipment 40. If the product is unacceptable, the product is diverted out of the processing system 10 and a generic or replacement product is fed in its place (Box 158). A generic product or book feeder 160 known to those skilled in the art is positioned along the mail table 38 to feed a generic product when necessary. Although not shown, a generic product feeder may be appropriately placed along the trimmer line 64 or any other suitable position to feed a generic product if a product is diverted from the system 10. The original label file results will coincide with the mailing output even if a generic product is needed (Box 162).

Although not shown, inkjet units, printer feeders and/or feeder pockets may be positioned along the mail table 38 if desired. In fact, such equipment may be placed anywhere along the system 10 depending on the output desired. Typically, the final delivery address is placed on the product along the mail table 38 but can be placed on the inside of the wrapping material so that a delivery person can look through the wrap to find the address.

Having described the overall apparatus and method according to the present invention, to further illustrate the invention, a method according to the invention is described with reference to Tables I–III. In this example, the product series comprises 200 magazines. Table I consists of the Original Label File for 200 magazines and the information which is downloaded to the stitcher controller 12 (Box 46) where:

S#=Sequence Number of Magazine;

WI=Wrap Indicator, where 0 indicates that the magazine is not to be wrapped and 1 indicates that the magazine is to be wrapped;

BT=Book Type which may be identified with numbers 1–6 identifying various Book Types customized to particular customers; and WBT=Wrapped Book Type which may be identified with letters A–D identifying various Wrapped Book Types customized to particular customers; 0 indicates the magazine is not to be wrapped.

TABLE I

ORIGINAL LABEL FILE

| S# | WI | BT | WBT | S# | WI | BT | WBT | S# | WI | BT | WBT | S# | WI | BT | WBT |
|---|---|---|---|---|---|---|---|---|---|---|---|---|---|---|---|
| 1 | 0 | 4 | 0 | 51 | 0 | 2 | 0 | 101 | 1 | 1 | B | 151 | 0 | 2 | 0 |
| 2 | 0 | 2 | 0 | 52 | 1 | 5 | C | 102 | 0 | 3 | 0 | 152 | 0 | 2 | 0 |
| 3 | 0 | 2 | 0 | 53 | 0 | 3 | 0 | 103 | 0 | 2 | 0 | 153 | 1 | 5 | B |
| 4 | 1 | 1 | D | 54 | 0 | 4 | 0 | 104 | 0 | 4 | 0 | 154 | 0 | 3 | 0 |
| 5 | 0 | 4 | 0 | 55 | 0 | 4 | 0 | 105 | 0 | 4 | 0 | 155 | 0 | 3 | 0 |
| 6 | 0 | 4 | 0 | 56 | 0 | 3 | 0 | 106 | 0 | 3 | 0 | 156 | 0 | 2 | 0 |
| 7 | 0 | 4 | 0 | 57 | 0 | 3 | 0 | 107 | 0 | 4 | 0 | 157 | 0 | 2 | 0 |
| 8 | 0 | 3 | 0 | 58 | 1 | 1 | C | 108 | 0 | 4 | 0 | 158 | 1 | 1 | D |
| 9 | 0 | 2 | 0 | 59 | 1 | 1 | B | 109 | 0 | 3 | 0 | 159 | 0 | 3 | 0 |
| 10 | 0 | 3 | 0 | 60 | 1 | 1 | B | 110 | 0 | 2 | 0 | 160 | 0 | 4 | 0 |
| 11 | 1 | 5 | C | 61 | 1 | 6 | D | 111 | 0 | 2 | 0 | 161 | 0 | 4 | 0 |
| 12 | 0 | 3 | 0 | 62 | 0 | 3 | 0 | 112 | 1 | 1 | A | 162 | 1 | 1 | A |
| 13 | 0 | 4 | 0 | 63 | 0 | 2 | 0 | 113 | 0 | 3 | 0 | 163 | 0 | 4 | 0 |
| 14 | 0 | 4 | 0 | 64 | 0 | 4 | 0 | 114 | 0 | 4 | 0 | 164 | 0 | 2 | 0 |
| 15 | 1 | 6 | B | 65 | 0 | 4 | 0 | 115 | 0 | 4 | 0 | 165 | 0 | 4 | 0 |
| 16 | 0 | 4 | 0 | 66 | 0 | 3 | 0 | 116 | 0 | 4 | 0 | 166 | 0 | 4 | 0 |
| 17 | 0 | 2 | 0 | 67 | 1 | 1 | B | 117 | 1 | 5 | B | 167 | 1 | 1 | C |
| 18 | 0 | 3 | 0 | 68 | 0 | 3 | 0 | 118 | 0 | 3 | 0 | 168 | 0 | 3 | 0 |
| 19 | 0 | 3 | 0 | 69 | 0 | 2 | 0 | 119 | 0 | 3 | 0 | 169 | 0 | 3 | 0 |
| 20 | 0 | 3 | 0 | 70 | 0 | 2 | 0 | 120 | 0 | 2 | 0 | 170 | 0 | 3 | 0 |
| 21 | 0 | 3 | 0 | 71 | 1 | 1 | C | 121 | 0 | 3 | 0 | 171 | 0 | 2 | 0 |
| 22 | 0 | 2 | 0 | 72 | 0 | 2 | 0 | 122 | 0 | 4 | 0 | 172 | 1 | 1 | C |
| 23 | 0 | 2 | 0 | 73 | 0 | 4 | 0 | 123 | 0 | 2 | 0 | 173 | 0 | 3 | 0 |
| 24 | 0 | 4 | 0 | 74 | 0 | 4 | 0 | 124 | 1 | 1 | D | 174 | 0 | 4 | 0 |
| 25 | 1 | 1 | A | 75 | 1 | 5 | A | 125 | 0 | 3 | 0 | 175 | 1 | 1 | A |
| 26 | 0 | 3 | 0 | 76 | 0 | 2 | 0 | 126 | 0 | 3 | 0 | 176 | 0 | 2 | 0 |
| 27 | 0 | 2 | 0 | 77 | 0 | 3 | 0 | 127 | 0 | 2 | 0 | 177 | 0 | 4 | 0 |
| 28 | 0 | 2 | 0 | 78 | 0 | 2 | 0 | 128 | 0 | 2 | 0 | 178 | 1 | 6 | D |
| 29 | 1 | 1 | C | 79 | 0 | 3 | 0 | 129 | 0 | 2 | 0 | 179 | 0 | 4 | 0 |
| 30 | 0 | 3 | 0 | 80 | 0 | 2 | 0 | 130 | 1 | 1 | C | 180 | 1 | 1 | C |
| 31 | 0 | 3 | 0 | 81 | 0 | 3 | 0 | 131 | 0 | 3 | 0 | 181 | 0 | 3 | 0 |
| 32 | 0 | 4 | 0 | 82 | 0 | 3 | 0 | 132 | 0 | 3 | 0 | 182 | 0 | 2 | 0 |
| 33 | 0 | 4 | 0 | 83 | 0 | 3 | 0 | 133 | 0 | 3 | 0 | 183 | 0 | 2 | 0 |
| 34 | 0 | 4 | 0 | 84 | 1 | 5 | C | 134 | 1 | 1 | B | 184 | 0 | 2 | 0 |
| 35 | 0 | 3 | 0 | 85 | 0 | 3 | 0 | 135 | 0 | 3 | 0 | 185 | 0 | 2 | 0 |
| 36 | 0 | 4 | 0 | 86 | 1 | 1 | C | 136 | 0 | 4 | 0 | 186 | 0 | 2 | 0 |
| 37 | 1 | 6 | D | 87 | 0 | 4 | 0 | 137 | 0 | 4 | 0 | 187 | 0 | 4 | 0 |
| 38 | 0 | 2 | 0 | 88 | 1 | 1 | B | 138 | 1 | 5 | C | 188 | 0 | 3 | 0 |
| 39 | 0 | 2 | 0 | 89 | 0 | 2 | 0 | 139 | 0 | 3 | 0 | 189 | 0 | 4 | 0 |
| 40 | 0 | 2 | 0 | 90 | 0 | 3 | 0 | 140 | 0 | 2 | 0 | 190 | 1 | 1 | D |
| 41 | 0 | 3 | 0 | 91 | 0 | 3 | 0 | 141 | 0 | 4 | 0 | 191 | 0 | 2 | 0 |
| 42 | 1 | 6 | D | 92 | 0 | 3 | 0 | 142 | 0 | 3 | 0 | 192 | 0 | 4 | 0 |
| 43 | 0 | 3 | 0 | 93 | 0 | 4 | 0 | 143 | 0 | 3 | 0 | 193 | 0 | 2 | 0 |
| 44 | 0 | 4 | 0 | 94 | 1 | 6 | C | 144 | 0 | 2 | 0 | 194 | 1 | 6 | B |
| 45 | 0 | 3 | 0 | 95 | 0 | 2 | 0 | 145 | 0 | 4 | 0 | 195 | 0 | 3 | 0 |
| 46 | 0 | 3 | 0 | 96 | 0 | 2 | 0 | 146 | 1 | 1 | B | 196 | 0 | 3 | 0 |
| 47 | 0 | 3 | 0 | 97 | 0 | 2 | 0 | 147 | 1 | 6 | C | 197 | 0 | 2 | 0 |
| 48 | 0 | 4 | 0 | 98 | 0 | 4 | 0 | 148 | 0 | 3 | 0 | 198 | 1 | 1 | D |
| 49 | 1 | 1 | B | 99 | 0 | 3 | 0 | 149 | 0 | 2 | 0 | 199 | 0 | 3 | 0 |
| 50 | 0 | 3 | 0 | 100 | 0 | 4 | 0 | 150 | 0 | 2 | 0 | 200 | 0 | 2 | 0 |

It should be noted that the original label file may contain additional data regarding each product than that shown.

Table II consists of the Sister Label File generated by the wrapper controller 34 (Box 48) where:

S#'=Sister Label Sequence Number of Magazine;

WBT=Wrapper Book Type; and (OSN)=Original Sequence Number (S#) from the Original Label File.

TABLE II

SISTER LABEL FILE

| S#' | WBT | (OSN) | S#' | WBT | (OSN) | S#' | WBT | (OSN) | S#' | WBT | (OSN) |
|---|---|---|---|---|---|---|---|---|---|---|---|
| 1 | D | (4) | 11 | B | (59) | 21 | B | (101) | 31 | D | (158) |
| 2 | C | (11) | 12 | B | (60) | 22 | A | (112) | 32 | A | (162) |
| 3 | B | (15) | 13 | B | (61) | 23 | B | (117) | 33 | C | (167) |
| 4 | A | (25) | 14 | B | (67) | 24 | D | (124) | 34 | C | (172) |
| 5 | C | (29) | 15 | C | (71) | 25 | C | (130) | 35 | A | (175) |
| 6 | D | (37) | 16 | A | (75) | 26 | B | (134) | 36 | D | (178) |

TABLE II-continued

| SISTER LABEL FILE | | | | | | | | | | | |
|---|---|---|---|---|---|---|---|---|---|---|---|
| S#' | WBT | (OSN) | S#' | WBT | (OSN) | S#' | WBT | (OSN) | S#' | WBT | (OSN) |
| 7 | D | (42) | 17 | C | (84) | 27 | C | (138) | 37 | C | (180) |
| 8 | B | (49) | 18 | C | (86) | 28 | D | (146) | 38 | D | (190) |
| 9 | C | (52) | 19 | B | (88) | 29 | C | (147) | 39 | B | (194) |
| 10 | C | (58) | 20 | C | (94) | 30 | B | (153) | 40 | D | (198) |

As explained, the sister label file identifies which magazines from the original label file are intended to be wrapped. Thus, forty out of the original 200 magazines are intended to be wrapped.

Table III contains the running file generated by the wrapper controller 34 (Box 50) where:

RFS#=Running File Sequence Number of Magazine;

PFS#=Pre-running File Sequence Number of Magazine [i.e., S# or (S#')]; and

OP#=Output Number of Magazine, which corresponds to the original sequence number (S#) from the Original Label File.

TABLE III

| RUNNING FILE | | | | | | | | | | | |
|---|---|---|---|---|---|---|---|---|---|---|---|
| RFS# | PFS# | OP# | RFS# | PFS# | OP# | RFS# | PFS# | OP# | RFS# | PFS# | OP# |
| 1 | (1) | 4 | 51 | 31 | 31 | 101 | 81 | 81 | 151 | 137 | 137 |
| 2 | (2) | 11 | 52 | 32 | 32 | 102 | 82 | 82 | 152 | 139 | 139 |
| 3 | (3) | 15 | 53 | 33 | 33 | 103 | 83 | 83 | 153 | 140 | 140 |
| 4 | (4) | 25 | 54 | 34 | 34 | 104 | (37) | 180 | 154 | 141 | 141 |
| 5 | (5) | 29 | 55 | 35 | 35 | 105 | 85 | 85 | 155 | 142 | 142 |
| 6 | (6) | 37 | 56 | 36 | 36 | 106 | (38) | 190 | 156 | 143 | 143 |
| 7 | (7) | 42 | 57 | (26) | 134 | 107 | 87 | 87 | 157 | 144 | 144 |
| 8 | (8) | 49 | 58 | 38 | 38 | 108 | (39) | 194 | 158 | 145 | 145 |
| 9 | (9) | 52 | 59 | 39 | 39 | 109 | 89 | 89 | 159 | 148 | 148 |
| 10 | (10) | 58 | 60 | 40 | 40 | 110 | 90 | 90 | 160 | 149 | 149 |
| 11 | (11) | 59 | 61 | 41 | 41 | 111 | 91 | 91 | 161 | 150 | 150 |
| 12 | (12) | 60 | 62 | (27) | 138 | 112 | 92 | 92 | 162 | 151 | 151 |
| 13 | (13) | 61 | 63 | 43 | 43 | 113 | 93 | 93 | 163 | 152 | 152 |
| 14 | (14) | 67 | 64 | 44 | 44 | 114 | (40) | 198 | 164 | 154 | 154 |
| 15 | (15) | 71 | 65 | 45 | 45 | 115 | 95 | 95 | 165 | 155 | 155 |
| 16 | (16) | 75 | 66 | 46 | 46 | 116 | 96 | 96 | 166 | 156 | 156 |
| 17 | (17) | 84 | 67 | 47 | 47 | 117 | 97 | 97 | 167 | 157 | 157 |
| 18 | (18) | 86 | 68 | 48 | 48 | 118 | 98 | 98 | 168 | 159 | 159 |
| 19 | (19) | 88 | 69 | (28) | 146 | 119 | 99 | 99 | 169 | 160 | 160 |
| 20 | (20) | 94 | 70 | 50 | 50 | 120 | 100 | 100 | 170 | 161 | 161 |
| 21 | 1 | 1 | 71 | 51 | 51 | 121 | 102 | 102 | 171 | 163 | 163 |
| 22 | 2 | 2 | 72 | (29) | 147 | 122 | 103 | 103 | 172 | 164 | 164 |
| 23 | 3 | 3 | 73 | 53 | 53 | 123 | 104 | 104 | 173 | 165 | 165 |
| 24 | (21) | 101 | 74 | 54 | 54 | 124 | 105 | 105 | 174 | 166 | 166 |
| 25 | 5 | 5 | 75 | 55 | 55 | 125 | 106 | 106 | 175 | 168 | 168 |
| 26 | 6 | 6 | 76 | 56 | 56 | 126 | 107 | 107 | 176 | 169 | 169 |
| 27 | 7 | 7 | 77 | 57 | 57 | 127 | 108 | 108 | 177 | 170 | 170 |
| 28 | 8 | 8 | 78 | (30) | 153 | 128 | 109 | 109 | 178 | 171 | 171 |
| 29 | 9 | 9 | 79 | (31) | 158 | 129 | 110 | 110 | 179 | 173 | 173 |
| 30 | 10 | 10 | 80 | (32) | 162 | 130 | 111 | 111 | 180 | 174 | 174 |
| 31 | (22) | 112 | 81 | (33) | 167 | 131 | 113 | 113 | 181 | 176 | 176 |
| 32 | 12 | 12 | 82 | 62 | 62 | 132 | 114 | 114 | 182 | 177 | 177 |
| 33 | 13 | 13 | 83 | 63 | 63 | 133 | 115 | 115 | 183 | 179 | 179 |
| 34 | 14 | 14 | 84 | 64 | 64 | 134 | 116 | 116 | 184 | 181 | 181 |
| 35 | (23) | 117 | 85 | 65 | 65 | 135 | 118 | 118 | 185 | 182 | 182 |
| 36 | 16 | 16 | 86 | 66 | 66 | 136 | 119 | 119 | 186 | 183 | 183 |
| 37 | 17 | 17 | 87 | (34) | 172 | 137 | 120 | 120 | 187 | 184 | 184 |
| 38 | 18 | 18 | 88 | 68 | 68 | 138 | 121 | 121 | 188 | 185 | 185 |
| 39 | 19 | 19 | 89 | 69 | 69 | 139 | 122 | 122 | 189 | 186 | 186 |
| 40 | 20 | 20 | 90 | 70 | 70 | 140 | 123 | 123 | 190 | 187 | 187 |
| 41 | 21 | 21 | 91 | (35) | 175 | 141 | 125 | 125 | 191 | 188 | 188 |
| 42 | 22 | 22 | 92 | 72 | 72 | 142 | 126 | 126 | 192 | 189 | 189 |
| 43 | 23 | 23 | 93 | 73 | 73 | 143 | 127 | 127 | 193 | 191 | 191 |
| 44 | 24 | 24 | 94 | 74 | 74 | 144 | 128 | 128 | 194 | 192 | 192 |
| 45 | (24) | 124 | 95 | (36) | 178 | 145 | 129 | 129 | 195 | 193 | 193 |
| 46 | 26 | 26 | 96 | 76 | 76 | 146 | 131 | 131 | 196 | 195 | 195 |
| 47 | 27 | 27 | 97 | 77 | 77 | 147 | 132 | 132 | 197 | 196 | 196 |
| 48 | 28 | 28 | 98 | 78 | 78 | 148 | 133 | 133 | 198 | 197 | 197 |
| 49 | (25) | 130 | 99 | 79 | 79 | 149 | 135 | 135 | 199 | 199 | 199 |
| 50 | 30 | 30 | 100 | 80 | 80 | 150 | 136 | 136 | 200 | 200 | 200 |

Preferably, the original label file is in demographic address order. In this way, the final output which coincides with the original label file will be in an order which allows for the maximum postal savings as previously explained. The apparatus and method according to the present invention does not assemble the books in demographic order as should be apparent with reference to the running file representatively shown in Table III. Not having to assemble the books in demographic order allows for greater flexibility in the overall system 10, particularly, the wrapping assembly 26, in order to allow for improved results.

As previously noted, a feature of the present invention is to provide a wrapping process which improves the overall operation of the wrapper 30. As a result, when the manufacturing process begins (Box 52), a predetermined number of products are sent to the pre-wrapper accumulating conveyor 28. In this example, the pre-wrapper accumulating conveyor 28 is adapted to hold twenty products, ten on the top tier 88 and ten on the bottom tier 90. It should be noted that the pre-wrapper accumulating conveyor 28 can be adapted to hold more or less than twenty products depending on the circumstances in each case.

With reference to Table II, there are forty magazines out of the list of 200 magazines that are to be wrapped in this set of products. With reference to Table III, the first twenty running file magazines correspond to the first twenty products to be wrapped as identified in Table II. Thus, the first ten magazines of the running file are sent to the top tier 88 of the pre-wrapper accumulating conveyor 28 (Boxes 96 and 98). Once tier 88 is full, the next ten magazines are directed into tier 90 (Box 100). As tier 90 is filling up, tier 88 is emptying by sending the first ten products on to the wrapper 30 (Box 104). The ten magazines from tier 88 are fed one right after the other through the wrapper 30 and delivered to tier 132 of the post-wrapper accumulating conveyor 32 where the products are collected until such time as they are to be delivered to the mail table 38 (Box 128). Once tier 88 is emptied and the speed control command changed as described above, tier 88 is again ready to receive additional products after tier 90 is full. Preferably, tiers 132 and 134 are designed to accumulate the same number of products as tiers 88 and 90.

With reference to Table III, as the first twenty magazines are making their way towards the wrapper 30, the twenty-first running file magazine is next in line. As shown in the running file list, the twenty-first running file magazine corresponds to the first original label file magazine and, therefore, the first output file magazine. As the twenty-first running file product makes its way through the system 10, since it is not to be wrapped, it is picked up by the wrapper bypassing conveyor 36. The twenty-second and twenty-third running file magazines correspond to the second and third output file magazines, respectively, neither of which is intended to be wrapped. As a result, the twenty-second and twenty-third magazines are also picked up by the wrapper bypassing conveyor 36. The twenty-fourth running file magazine has been designated for wrapping. Thus, it will enter previously emptied tier 88. The twenty-fifth through the thirtieth running file magazines will enter the wrapper bypassing line 108. The thirty-first running file magazine, having been designated for wrapping, will enter the next position in tier 88. The thirty-second running file magazine through the thirty-fourth running file magazines will enter the wrapper bypassing line 108, and so on.

When the twenty-fourth and the thirty-first running file magazines are removed from the stream of products on the conveying line 22, a gap will be created in the stream of products traveling along the wrapper bypassing line 108. As the twenty-first through twenty-third running file magazines are deposited on the mail table (the first, second and third output magazines), the fourth output magazine corresponds to a wrapped magazine as shown in Table I. With reference to Table III, the fourth output file magazine corresponds to the first running file magazine now cued up in the top tier 132 of the post-wrapper accumulating conveyor 32. After the third output magazine (i.e., the twenty-third running file magazine) is deposited on the mail table 38 from the wrapper bypassing conveyor 36, the post-accumulating conveyor 32 delivers the fourth output magazine (i.e., the first running file magazine) to the mail table 38 which falls in line with the previously deposited output products. The first running file magazine will be deposited in the gap created between the twenty-third and twenty-fifth running file magazines in the stream of products that traveled along the wrapper bypassing line 108. As a new gap reaches the mail table 38, the appropriately destined product in the post-wrapper accumulating conveyor 32 will be delivered to the mail table 38 to fill the gap.

As should now be understood, the twenty-fourth running file magazine will travel through the wrapper assembly 26 and be deposited on the mail table 38 when output magazine one hundred one is scheduled to be deposited. This magazine will fill a gap created between running file magazines one hundred twenty and one hundred twenty one. As noted, the tier 88 accepts the twenty-fourth running file magazine and the next nine magazines to be wrapped (RFS#'s 31, 35, 45, 49, 57, 62, 69, 72 and 78) before delivering these products to the wrapper 30. As these RFS#'s are being delivered to the wrapper 30, tier 90 is ready to accept the next ten products to be wrapped (RFS#'s 79, 80, 81, 87, 91, 95, 104, 106, 108 and 114). The process continues until the last magazine is deposited on the mail table 38.

It should be recognized that the present invention greatly enhances the flexibility of customizing signatures in a binding and wrapping system and allows magazines having various types of customization to be produced for subscribers in a given postal zone. For example, it may be desirable to send to one subscriber an unwrapped magazine with personalized messages and send his neighbor, a new subscriber, a wrapped magazine including a coupon for free/discounted merchandise, a welcome greeting and a sample of a flat packaged new product such as a compact disk, a shampoo packet, or the like. Unlike prior art systems which wrap each customized publication apart from those publications bound in a binding system, the present invention provides improved selectivity by combining a binding line with a wrapping line, which saves money and time by wrapping only preselected products from a single stream of products, yet offers further customization and optimal sortation.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A method of assembling and organizing wrapped and unwrapped products, the method comprising:

providing an input list of products, the list including data identifying which of the products are to be wrapped and an order in which the products are to be arranged for shipment to similar demographic locations;

generating an operating list using information on the input list, the operating list identifying a sequence in which the products are to be assembled;

assembling the products in the sequence identified on the operating list;

dividing the assembled products into a first group containing products which will be wrapped and a second group containing products which will not be wrapped according to the input list;

transporting the first group of products to a wrapper;

wrapping the first group of products; and merging the first group of wrapped products and the second group of unwrapped products into the order set forth in the input list.

2. The method of claim 1 wherein the products are magazines.

3. The method of claim 1 wherein transporting the first group of products to a wrapper includes accumulating a predetermined number of products before the wrapper.

4. The method of claim 3 wherein accumulating the predetermined number of products before the wrapper includes supplying the first group of products to the wrapper along multiple paths.

5. The method of claim 4 wherein supplying the first group of products to the wrapper along multiple paths includes delivering products to the wrapper from one path while receiving products along a separate path.

6. The method of claim 1 further comprising accumulating wrapped products before merging the first group of wrapped products and the second group of unwrapped products.

7. The method of claim 6 wherein accumulating wrapped products before merging the first group of wrapped products and the second group of unwrapped products includes delivering the first group of products from the wrapper along multiple paths.

8. The method of claim 7 wherein delivering the first group of products from the wrapper along multiple paths includes delivering wrapped products from the wrapper along one path while receiving wrapped products from the wrapper along a separate path.

9. The method of claim 1 wherein the input list includes subscriber names, codes, addresses, or messages.

10. The method of claim 1 wherein generating an operating list using information on the input list includes downloading the input list to a control system that determines which of the products require wrapping.

11. The method of claim 10 wherein generating an operating list using information on the input list includes determining an assembly sequence based upon relative numbers of wrapped and unwrapped products.

12. The method of claim 11 wherein generating an operating list using information on the input list includes determining an assembly sequence based upon amounts of products that are being delivered to similar demographic locations.

13. The method of claim 1 wherein wrapping the first group of products includes providing an invoice within at least some of the wrapped products, the invoice being specified by the input list.

14. The method of claim 1 wherein assembling the products includes assembling individualized products based on customization information within the input list.

15. The method of claim 14 wherein wrapping the first group of products includes wrapping at least some of the products with customized packaging based on customization information within the input list.

16. The method of claim 1 further comprising printing customized information onto at least some of the products based on customization information within the input list.

17. The method of claim 1 further comprising packaging wrapped and unwrapped products together that are destined for shipment to similar demographic locations.

18. The method of claim 17 wherein the similar demographic locations are postal zip codes.

19. The method of claim 1 further comprising testing each of the products.

20. The method of claim 19 wherein testing each of the products includes replacing unsatisfactory products with generic products while maintaining the order set forth in the input list.

* * * * *